United States Patent [19]

Weiss et al.

[11] Patent Number: 4,938,620

[45] Date of Patent: Jul. 3, 1990

[54] WRITING POINT OR TRACING ELEMENT

[75] Inventors: Peter Weiss, Fürth; Karl Kaiser, Wendelstein, both of Fed. Rep. of Germany

[73] Assignee: J. S. Staedtler GmbH & Co.

[21] Appl. No.: 237,734

[22] PCT Filed: Oct. 26, 1987

[86] PCT No.: PCT/DE87/00484

§ 371 Date: Jul. 26, 1988

§ 102(e) Date: Jul. 26, 1988

[87] PCT Pub. No.: WO88/03875

PCT Pub. Date: Jun. 2, 1988

[30] Foreign Application Priority Data

Nov. 26, 1986 [DE] Fed. Rep. of Germany ..... 3640320

[51] Int. Cl.[5] ..... B43K 8/00; B43K 5/10

[52] U.S. Cl. ..... 401/260; 401/258; 401/232; 401/219

[58] Field of Search ..... 401/223, 225, 226, 227, 401/229, 230, 232, 236, 237, 242, 253, 258–260, 205, 206, 219; 346/140 R

[56] References Cited

U.S. PATENT DOCUMENTS

| | | | |
|---|---|---|---|
| 2,681,041 | 6/1954 | Zodtner et al. | 401/242 X |
| 3,756,733 | 9/1973 | Glasa et al. | 401/259 |
| 3,836,266 | 9/1974 | Lorenz et al. | 401/259 |
| 3,859,190 | 1/1975 | Kuelichen, Jr. | 401/258 X |
| 4,461,591 | 7/1984 | Mutschler | 401/258 |
| 4,522,525 | 6/1985 | Saito et al. | 401/258 |
| 4,728,214 | 3/1988 | Mutschler | 401/258 |
| 4,753,546 | 6/1988 | Witz et al. | 401/242 X |

FOREIGN PATENT DOCUMENTS 1947421 8/1965 Fed. Rep. of Germany .

*Primary Examiner*—Richard J. Apley
*Assistant Examiner*—David J. Bender
*Attorney, Agent, or Firm*—Toren, McGeady & Associates

[57] ABSTRACT

The housing (1') of a writing point (1) or tracing element for manual ink writing or drawing instruments or for plotter or similar automatic or mechanical tracing machines is or can be linked with a shaft (40) that contains the ink and/works as a holder and/or storage. The housing has also a compensating system and a writing body (1") and if necessary other parts. It is provided with a supply system having in the area of the housing (1') several annular spaces (52 and 57) arranged axially one after the other and having different capillarities, their capillarity increasing one or more times in the direction of the writing body (1"). At least one annular space is conically shaped (53) and has a capillarity different from that of the writing body (1"), increasing in the direction of the latter.

22 Claims, 5 Drawing Sheets

WRITING POINT OR TRACING ELEMENT

BACKGROUND OF THE INVENTION

1. Field of the Invention

The invention relates to a writing point or a tracing element for manual ink writing or drawing instruments or for plotter or similar automatic or mechanical tracing machines.

2. Description of the Prior Art

In the German utility model No. 1947 421 as well as in the CH-patent 451 745 such writing points are represented and described in their essential features. Even though it might be true that these known writing points already were rather safe against running-out and guaranteed a relatively even flow of ink, they do not satisfy the requirements of quality of nowadays any more. Especially in the case of work that has to be done very fast, respectively under high traction speeds [drawing speeds], for example in the case plotters or similar installations, the flow of the writing medium might be changed, or even cut off, and thus uneven or uncomplete lines can be caused. Besides, these writing points can run out relatively easily under strong oscillations of temperature or pressure and thus cause pollution in their environment, and later, when the writing mean possibly drys,—especially if the tracing ink in the ventilation—or balancing system dries, expensive works of maintenance can be made necessary.

Thus it is an object of the present invention to provide a writing point, respectively a tracing element, which even under very high working—or traction speeds guarantees evenly and completely drawn lines, respectively swabs and provides a relatively high safety against running out and thus virtually does not require any maintenance.

SUMMARY OF THE INVENTION

This task is resolved by a writing point or tracing element for manual ink writing or drawing instruments or for plotters or similar automatic or mechanical tracing machines, wherein the housing of the writing point is connected or connectable with a shaft. The shaft contains ink or india ink and serves as a holder and/or a storage space and a compensating system as well as further individual elements. The supply system includes in the area of the housing several spaces which all provide different capillarities, and which are disposed in an axial sequence, the capillarity increasing once or several times towards the writing body.

DESCRIPTION OF THE PREFERRED EMBODIMENT

Figure 1:
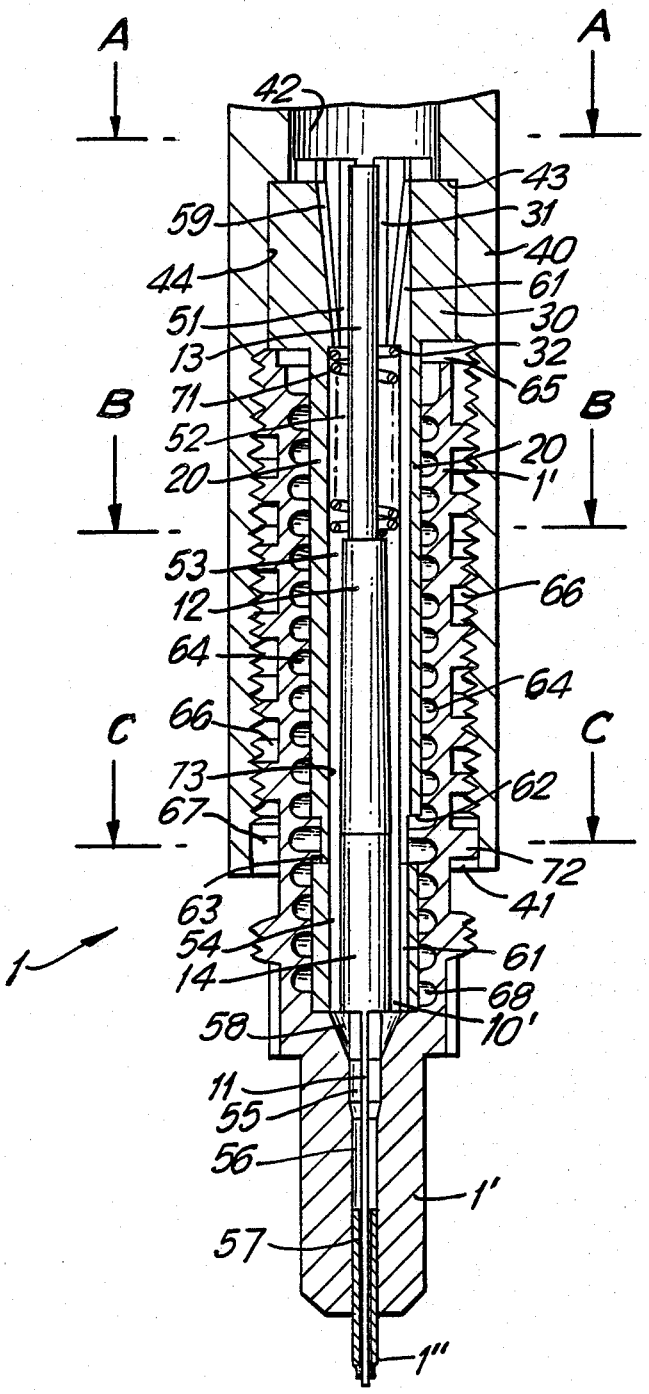
FIG. 1 shows an inventive writing point with a shaft.

The writing point (1) shown in FIG. 1 is inserted into a shaft (40) and provides basically a housing (1'), a tube (1'') as writing body which is inserted firmly into the housing, a sealing tube insert (20) which closes the channels of the compensating channel (64), and a core insert which is movable in the axial direction against the pressure of a spring (71).

The shaft (40) provides apart from the receiving space (41), into which the writing point (1) is screwed, a storage space (42) for the ink, india ink or for another liquid medium and thus represents the storage space for the writing means as well (cartridge, shell case or something of that kind).

The housing (1'), which is inserted sealing into the receiving space (41) with its circumferential surface, provides in its mantle surface an outer channel (66), which rotates several times, a compensating channel (64) running in the inner side in the shape of a spiral and a connecting channel (65) at the rear end and thus comprises the essential elements of the compensating system.

The tube insert (20) is inserted axially continuously sealing into the boring of the housing (1') and rests sealing in mounted condition with its firmly disposed lock (30) against a sealing stop (43).

The lock (30) thus prevents the direct entry of the writing medium into the compensating system and seals its connection channel (65) at the rear side. The boring (73), which substantially is cylindrical provides at the rear side supporting stops (32) for the spring (71) and then continues as an intake well [inlet boring] (31) with capillary intake tubes (59) up to the rear end.

Into the half of the side of the writing body (first half), a rotating annular channel (63), preferably capillary is worked in, and starting from this annular channel (63) a connecting channel (62), which preferably is fashioned as a non-capillary boring or as a rectangular break-through, penetrates completely the wall of the tube insert which opens out in the area of the non-capillary air channel (61) into the inner side of the writing point (1), the non-capillary air channel (61) being disposed in the boring (73) and extending axially up to into the storage space (42).

The core insert (10') provides a rearward pin (13), which here is fashioned cylindrical, but which can also be fashioned as a cone, and provides a cone (12), a subsequent cylinder piece (14) and a firmly inserted needle (11).

The supply system is composed essentially of the inlet space (51), which is formed by the inlet boring (31) and the pin (13) the inlet space preferably is capillary. Into this intake space the capillary intake tubes (59) open out radially. And the supply system is composed of the inner space (52), formed by the cylindrical boring (73) and the pin (13), the inner space (52) in general being non-capillary and receiving the spring (71).

The supply system is further composed of the conical space (53), which provides an increasing capillarity, and which is formed by the cylindrical boring (73) and the annular space formed by the mantle of the cone (12). The supply system is composed of the capillary holding space (54) between the cylinder piece (14) and the boring (73), out of the intermediate storage space (55) which is partly penetrated by the radial supply channels (58) and the writing storage space (56) and the writing space (57). The intermediate storage space (55), the writing storage space (56) and the writing space (57) are fashioned as annular spaces with an increasing capillarity towards the writing body (1'') by stepped borings in the housing (1') as well as in the writing tube (1''), and the outer surface of the needle (11), which is movable axially with the core insert (10') and which projects a little past the writing tube (1'') at the front face.

The lock (30), which is inserted centrically and possibly sealing into the fitting boring (44) of the shaft (40) and a spigot (72), which provides an air outlet [inlet] (67), and which rests in case of need sealing against the wall of the receiving space (41) of the shaft (40) being centered at the front, serve for a secure coaxial fixing of the writing point (1) in the shaft (40).

The figure shows very clearly as well, that in the case of the represented example of embodiment of the invention, which is particularly advantageous, the connecting channel (62) between the supply and the compensation system opens out into the cone space virtually in the area of the highest capillarity of the cone space (53), and still touches the subsequent holding space (54), which provides a high capillarity. The spring (71) can be omitted and the core insert (10'), which here is made up of plastic, can be disposed axially freely movable. The core insert (10') may also be other material to provide another specific gravity.

The compensation system is especially effective, if it is composed of an inner compensating channel (64) or a compensating channel connected in series, which provides the shape of a spiral or of a meander. The compensation channel (64) can continue axially beyond the connecting channel (62) and thus, if need be, form an additional buffer zone (68), which opens out either into the intermediate storage space (55), or which just receives a small amount of the writing medium as a balancing channel, which is closed at one side.

Figure 2:
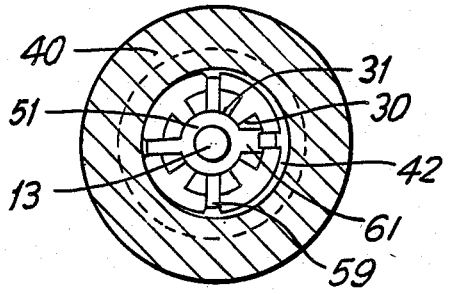
FIG. 2 shows a cross section through the shaft according to line A—A in FIG. 1.
Figure 3:
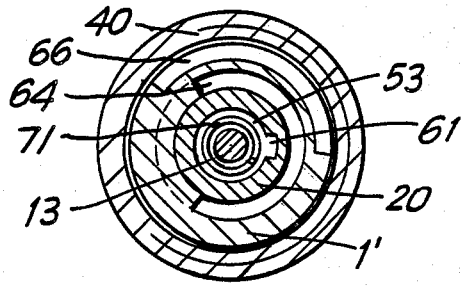
FIG. 3 shows a cross section through the shaft and the writing point according to line B—B in FIG. 1.
Figure 4:
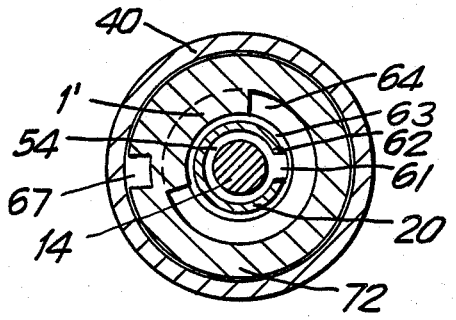
FIG. 4 shows a cross section through the shaft and the writing point according to line C—C in FIG. 1.

The cross sections shown in the FIGS. 2 through 4 represent the axial course of the individual zones and areas as well as their cross-sections.

In the shaft (40) (according to FIG. 2) over the storage space (42) the lock (30) is to be seen with the inlet boring (31) and the intake tubes (59). The axially continuous air channel (61), which is non-capillary opens out into the inlet space (51), formed by the pin (13) and the inlet boring (31).

FIG. 3 shows in addition to this the outer channel (66), which is fastened to the housing (1') and which provides the shape of a spiral, shows the compensating channel (64), which provides the form of a spiral as well, and shows.the cone space (53), the tube insert (20) and the spring (71). FIG. 4 shows the spigot (72), providing an air outlet (67), the connecting channel (62) which penetrates the tube insert (20) radially and which opens out into the annular channel (63), the capillary holding space (54) and the cut cylinder piece (14).

Figure 5:
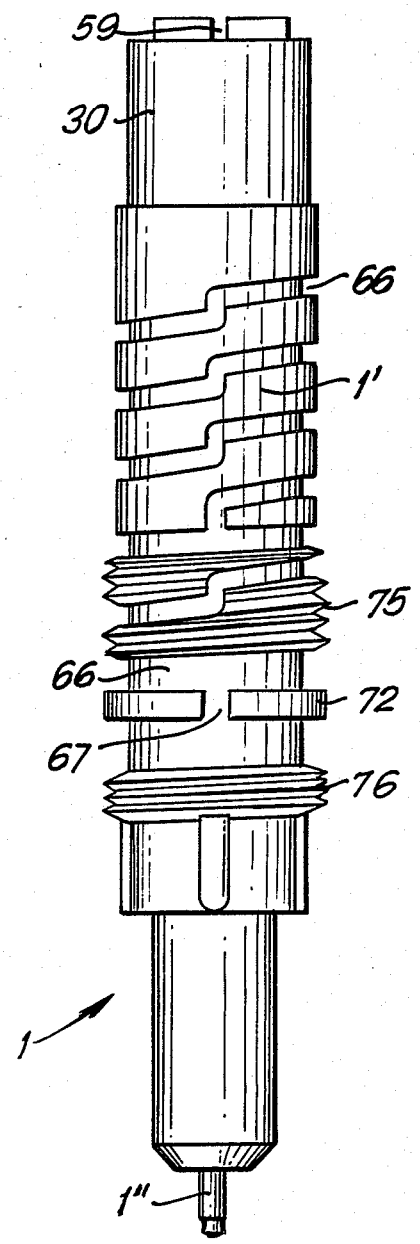
FIG. 5 shows the writing point pursuant to FIG. 1 without shaft.

The writing point (1) according to the FIG. 5 provides basically the writing tube (1''), which is inserted firmly into the housing (1'), an inlet channel (59), which can be seen at the lock (30), a graduated recessed outer channel (66) and a spigot (72), which is pierced by an air inlet (67).

By means of a connecting thread (75) this point can be fastened in the shaft or in a holder or in a cartridge, and a locking thread (76) can serve for the fastening of the locking cap, which is not represented here.

Figure 6:
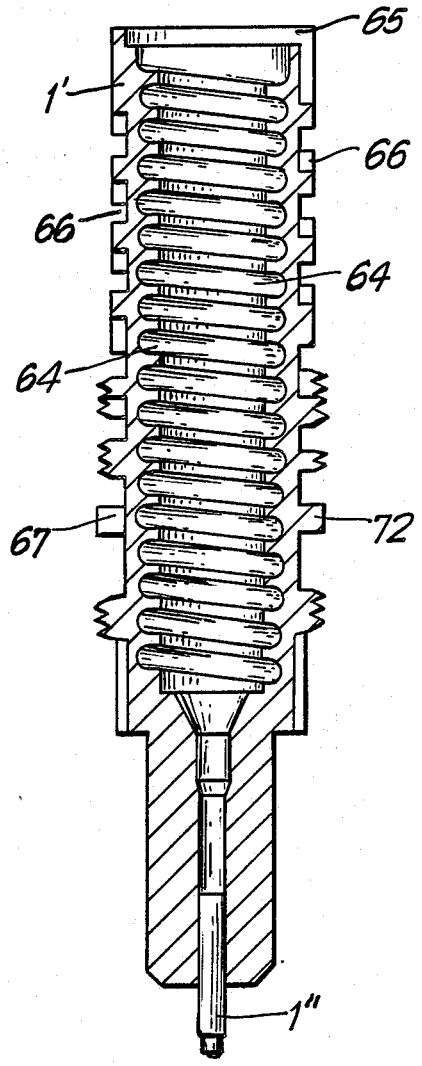
FIG. 6 shows the writing point pursuant to FIG. 1 without shaft or inner parts.

Pursuant to FIG. 6 the writing tube (1'') is pressed into the front zone of the housing (1'). The outer channel (66), which is connected to the outer air by the air inlet (67), the air inlet (67) penetrating the spigot (72) axially, is in contact at the rear end with the compensation channel (65), the compensation channel (64) providing the shape of a spiral and being disposed inside, so that at all times air, and that in case of need writing medium also can come into the outer channel (66), which in that case has the function of a surplus chamber. If this outer channel (66) is fashioned capillary or if it is provided continuously with capillary zones, any writing medium which has entered will usually flow out automatically when the pressure decreases.

Figure 7:
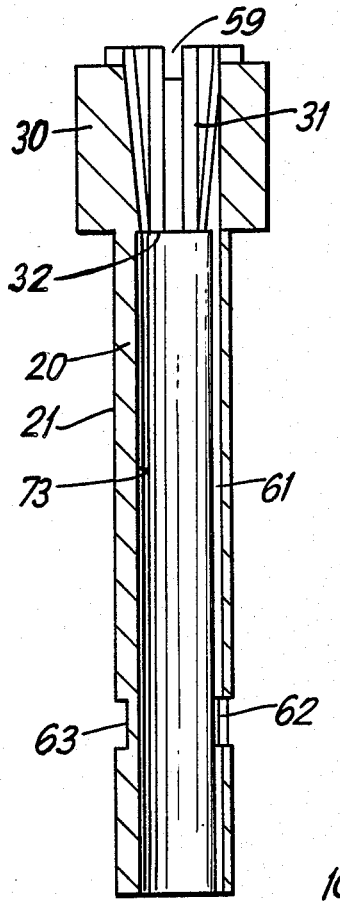
FIG. 7 shows the tube insert pursuant to FIG. 1.

FIG. 7 represents the tube insert (20) and shows the annular channel (63), extending on the outer mantle (21). The connection channel (62), penetrates the wall radially in the annular channel (63) and in the axially extending air channel (61). The supporting stop (32), delimits the cylindrical boring (73) in the rear against the inlet boring (31) and the lock (30) provides intake tubes (59).

Figure 8:
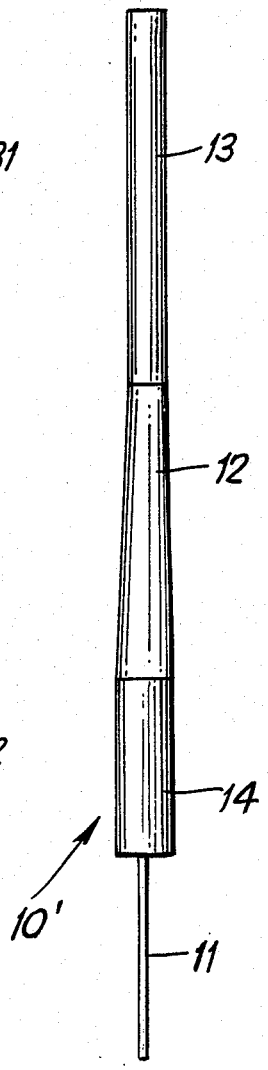
FIG. 8 shows the core insert pursuant to FIG. 1.

The core insert (10') according to FIG. 8 is composed essentially of the needle (11), which is inserted into the cylinder piece (14), respectively of the cleaning thread [wire], usually applied in tube writing instruments, of the cone (12) and of the pin (13). The pin can preferably be made up of thermoplastic synthetic or of metal, ceramic or something of that kind.

Figure 9:
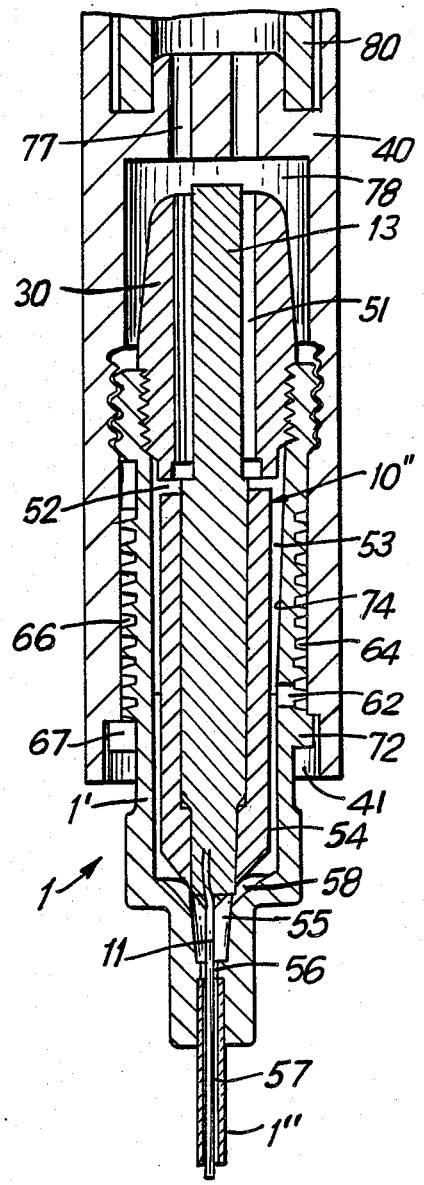
FIG. 9 shows another embodiment of the inventive writing point.

The writing point (1), which also provides a writing tube (1') and which is screwed into a holder (40) pursuant to FIG. 9 provides a core insert (10''), fashioned as a falling weight, with a pin (13) and a needle (11) and a lock (30).

Here the writing medium comes out of a shell case (80), disposed in the shaft, and comes over breakthroughs (77) and an intermediate chamber (78) into the inlet space (51), which is penetrated by the pin (13) and comes furthermore over the inner space (52) and over the cone space (53), which is formed by the cylindrical mantle of the core insert (10''), and over the holding space (54) and over the supply channels (58) into the intermediate storage space (55), into the writing storage space (56) and into the writing space (57).

The compensation of the writing medium is carried out of the cone space (53) and/or out of the holding space (54) over the connection channel (62) into the compensation channel (65), which is not shown here, to the outer channel (66) and through the outer channel (66) to the front and over the air inlet (67) disposed in the spigot (72). In the case of the writing point pursuant to FIG. 10 the writing body is formed by a writing ball (2''), which is fed with relatively liquid writing medium-preferably with ink over a cylindrical core insert (10'''), fashioned as a supply wick, as well as over the receiving space (51), which provides a conical shape here, over the proper cone space (53), over the holding space (54), over the supply channels (58) and over the writing space (56).

The wall of the boring (74) of the tube insert (20), which runs in a conical shape at least up to the connection channels (62), is interrupted axially by two non-capillary air channels passing through, which at the rear end of the locking (30) open out into the writing medium storage space (not represented here).

In the course of this the air is carried out over the air channels (61) and over the two connecting channels (62), which open out into the air channels (61) and into the annular channel (63), over the compensating channel (64), over the connecting channel (65), over the outer channel (66) and over the air inlet (67). The compensating channel (64), which is cut into the inside of the housing (2') is covered or closed by the outer mantle (21) of the tube insert (20).

Figure 11:
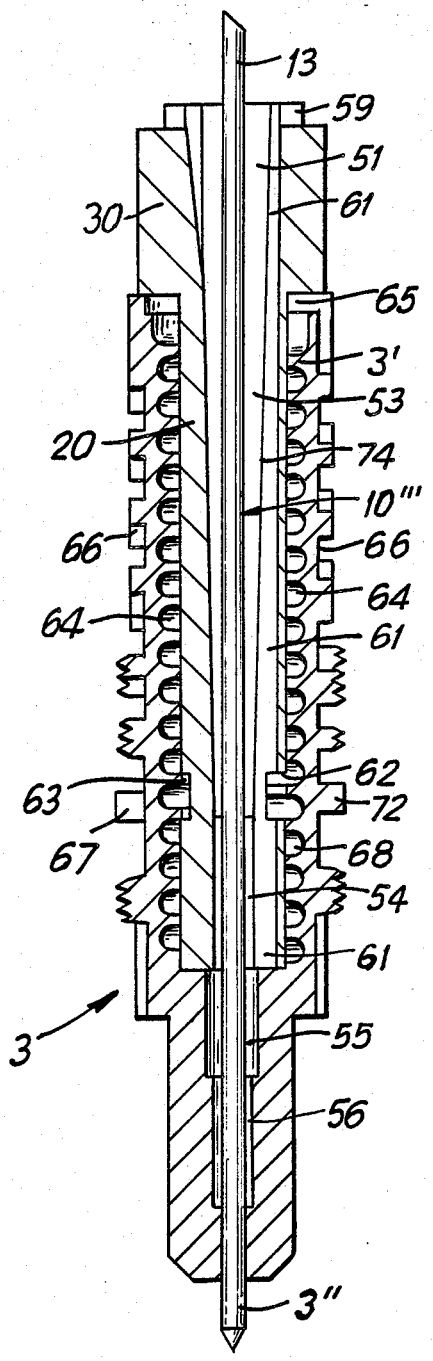

The writing point (3) shown in FIG. 11 provides a writing wick (3'') as a writing body, the rearward prolongation of which forms also the capillary, cylindrically fashioned core insert (10'''), which projects over the writing point towards the rear side.

Figure 10:
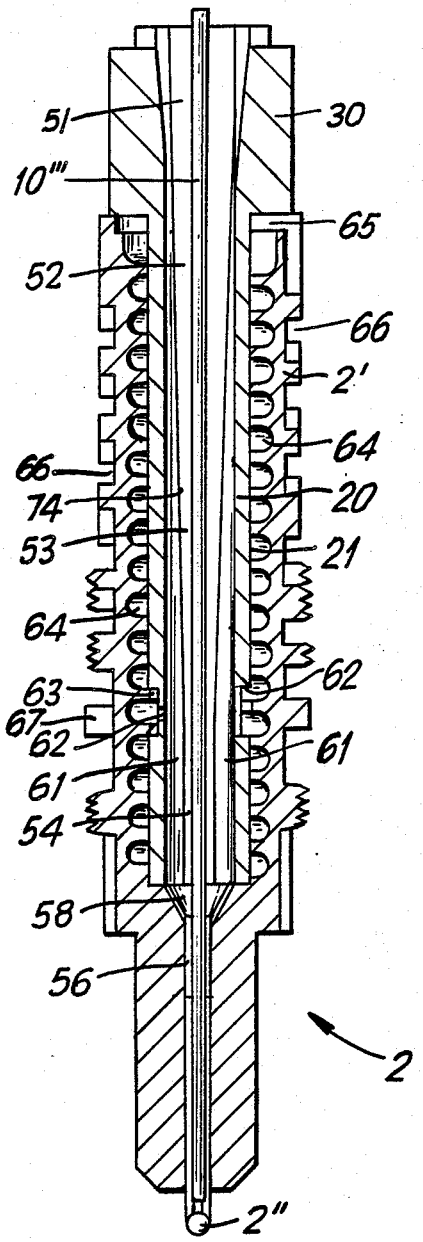
FIG. 10 shows a variant with a writing ball and FIG. 11 shows a further variant with a writing wick.

In analogy to FIG. 10 here the writing medium flows through the highly capillary core insert (10''') as well, and in addition to this, if need be it flows over the inlet channels (59) and over the annular spaces, which are formed by the conical boring (74) and which provide an increasing capillarity, as well as over the inlet space (51), the cone space (53), the highly capillary holding space (54), the intermediate storage space (55) and the writing storage space (55) and the writing space (56), provided that the writing wick (3'') or the core insert (10''') comprise in these areas an outer wall, which is permeable for the writing medium. If this is not the case, the inlet of the writing medium and its transport is carried out up to the point over the highly capillary center of the core insert (10''') or of the writing wick (3''). In that case the annular spaces (51 through 56), which are provided in case of need, serve solely to compensate the surplus of the compensating system (60), which in addition to this also provides at least an axial non-capillary air channel (61) as well as a connection channel (62), and an annular channel (63), a compensating channel (64), a connecting channel (65), and an outer channel (66) and an air inlet (67). The lock (30), which is disposed at the tube insert (20) provides inlet channels (59), which are directed radially towards the inside, which open out into the inner space (51) and which are at least partly capillary. The rearward end—here inclined—usually projects into the ink storage space, which can provide an absorbent storage filling.

The core insert (10'') shown in FIG. 9 as well as the core inserts (10''') of the examples of embodiment of FIG. 10 and 11 can provide a continuous capillary supply wick and if need be a shell case serving as a balance body. The attachment of the needle (11) is carried out in the shell case or in the supporting wick, which [the wick] in addition to this projects over the shell case with the pin (13) towards the back, and which [the wick] penetrates it in the front entirely or partly, if necessary. If for reasons of the specific system no axial movement of the core insert (10'') is necessary or desirable, the core also can be fixed firmly and stationary in the housing (1').

We claim:

1. A writing or tracing element for manual ink writing or drawing instruments or for plotters or other automatic or mechanical tracing machines, the element comprising an essentially tubular housing, the housing adapted to be connected to a shaft which serves as a holder and defines a storage space for ink, the housing including a compensation system and defining a central bore, a core insert being inserted in the bore of the housing, a writing body being attached to an end of the housing, a supply system for the ink comprising a plurality of annular spaces being defined between the core insert and the housing, the annular spaces having different widths in axial direction, such that different capillary forces act on the ink in the annular spaces, at least one of the annular spaces being a conical space, wherein the width of the at least one conical space decreases toward the writing body such that the capillary forces acting on the ink increase toward the writing body.

2. The element according to claim 1, comprising successively in axial direction between the conical space and the writing body an intermediate storage space, a writing storage space and a writing space.

3. The element according to claim 2, wherein the intermediate space includes supply channels.

4. The element according to claim 2, comprising a connecting channel which connects the supply system and the compensating system, the connecting channel opening into the conical space at an end of the conical space which faces the writing body.

5. The element according to claim 4, comprising an air channel which axially extends through the annular spaces, the air channel having a width which prevents capillary action on the ink from occurring, the connecting channel opening into the supply system at the air channel.

6. The element according to claim 4, wherein the housing has an inner circumferential surface defining the bore and an outer circumferential surface, the compensation system being composed of a spirally extending inner compensation channel defined in the inner surface and an outer channel defined in the outer surface, and a second connecting channel between the inner channel and the outer channel.

7. The element according to claim 6, wherein the outer channel extends spirally.

8. The element according to claim 6, wherein the outer channel extends meander-like.

9. The element according to claim 6, wherein the outer channel is connected to an air inlet.

10. The element according to claim 6, wherein the inner compensation channel has a half which faces the writing body, the connecting channel opening into the half of the inner compensation channel facing the writing body, and wherein the second connecting channel leading to the compensation channel is arranged at the rearward end of the housing.

11. The element according to claim 6, wherein the inner compensation channel extends past the connecting channel toward the writing body and ends in the intermediate storage space.

12. The element according to claim 6, wherein the inner compensation channel extends past the connecting channel toward the writing body and ends shortly in front of the intermediate storage space.

13. The element according to claim 4, comprising a tubular insert between the core insert and the housing, the tubular insert having an outer surface, the connecting channel opening into an annular channel defined in the outer surface of the tubular insert.

14. The element according to claim 1, wherein a capillary holding space is provided axially between the conical space and the writing body.

15. The element according to claim 14, wherein the capillary holding space is arranged axially between the conical space and an intermediate storage space.

16. The element according to claim 1, wherein the conical space is formed by the central bore of the housing being cylindrical and by a conical portion of the core insert which widens toward the writing body.

17. The element according to claim 1, wherein the conical space is formed by the core insert being cylindrical and by a conical portion of the central bore of the housing which narrows toward the writing body.

18. The element according to claim 1, wherein the core insert has first and second ends, a rearward pin connected to the first end and a needle connected to the second end, the core insert being disposed movable in axial direction against the pressure of a spring.

19. The element according to claim 18, wherein the rearward pin extends essentially axially completely through the housing.

20. The element according to claim 18, wherein the housing has a rearward lock, the rearward pin extending essentially axially entirely through the rearward lock.

21. The element according to claim 1, wherein the core insert has first and second ends, a rearward pin connected to the first pin and a needle connected to the second end, the core insert being disposed movable in axial direction against the pressure of a weight.

22. The element according to claim 1, wherein the core insert comprises a capillary supply wick and is axially immovably mounted in the housing.

* * * * *